United States Patent [19]

Meschi

[11] 4,342,418

[45] Aug. 3, 1982

[54] BLANK FOR THE TRANSMISSION OF INFORMATION HAVING IMPROVED PREGLUED SEALING AREAS

[76] Inventor: Luciano Meschi, Corso Amedeo 73, 57100 Livorno, Italy

[21] Appl. No.: 177,987

[22] Filed: Aug. 14, 1980

[51] Int. Cl.[3] ..... B65D 27/00; B65D 27/12

[52] U.S. Cl. ..... 229/92.1; 229/92.3

[58] Field of Search ..... 229/92, 92.1, 92.3

[56] References Cited

U.S. PATENT DOCUMENTS

| | | | |
|---|---|---|---|
| 2,773,638 | 12/1956 | Krohn | 229/92.1 |
| 3,197,121 | 7/1965 | Hayes | 229/92.1 |
| 3,255,952 | 6/1966 | Black | 229/92.1 |
| 3,325,188 | 6/1967 | Hiersteiner | 229/69 |
| 3,995,808 | 12/1976 | Kehoe | 229/92.1 |
| 4,199,630 | 4/1980 | Consiglio | 229/69 |
| 4,277,016 | 7/1981 | Wakeman | 229/80 |

FOREIGN PATENT DOCUMENTS

| | | | |
|---|---|---|---|
| 597326 | 8/1925 | France | 229/92.1 |

*Primary Examiner*—Herbert F. Ross

*Attorney, Agent, or Firm*—McAulay, Fields, Fisher, Goldstein & Nissen

[57] ABSTRACT

A foldable blank for information and data transmission, wherein glue coated parts and cut-outs are provided, whereby the glue is applied to predetermined areas of only one face of the blank.

7 Claims, 3 Drawing Figures

BLANK FOR THE TRANSMISSION OF INFORMATION HAVING IMPROVED PREGLUED SEALING AREAS

The present invention relates to a continuous blank for the transmission of data, which can be folded and glued to itself, either reversibly or in a fixed way, and which does not require an envelope for the mailing.

It is known that the blanks or forms for the transmission of information, such as for instance those used for the business mail, have a glueing system whereby the areas involved in the glueing are the three adjacent protruding edges of one face of the blank and the area adjacent to the center folding line of the other face of the form, thus permitting the sealing of the blank, in the four times folded form.

It is thus understood that the systems for the glue coating of the aforesaid glueing areas must firstly deposit the glue on the side parts of a first face of the blank and then deposit the glue on the central area of the other face of the blank.

The purpose of the invention is that of permitting a one side glue application, namely to deposit glue, either of the reversible or of the irreversable type, on only one face of the blank without varying the folding and sealing characteristics of the blank.

According to the invention this purpose is achieved by providing a blank for the transmission of information and data and adapted to stably remain in a folded condition, comprising a sheet divided by a folding line into a first and a second part, the first part having the edges protruding from the three sides coated with reversible or irreversible glue on one face, wherein, on the same face, a further strip of the first part adjacent to the folding line is coated with glue, in a corresponding strip of the second part adjacent to the folding line there being formed guards or cut-outs, symmetrically with respect to the middle line of the sheet orthogonal to the said folding line.

The features and advantages of the blank according to the invention shall be more evident from the following description of an exemplifying embodiment, as shown in the enclosed drawings, in which.

Figure 1:
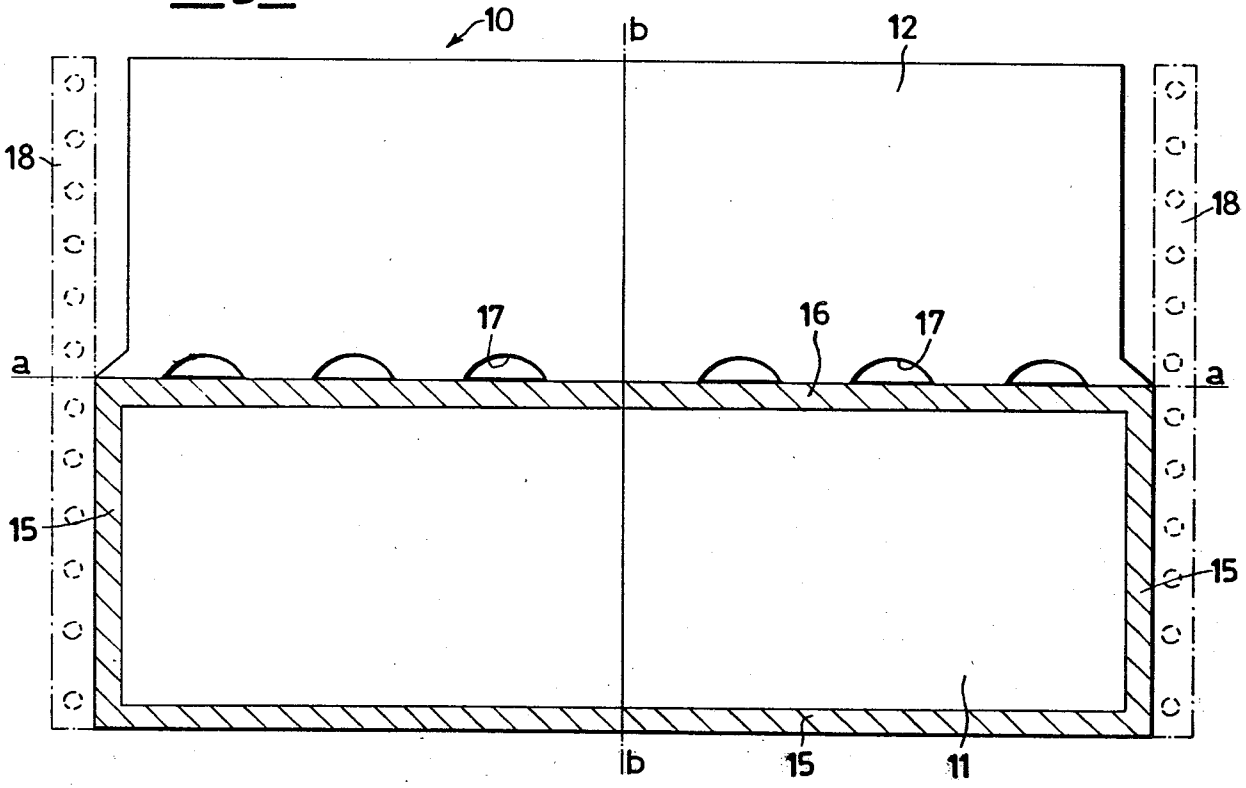
FIG. 1 is a front view of a blank according to the invention.

As a non limiting example, the blank, as generically indicated by the reference 10, is divided in a first part 11 and a second part 12 by a folding line a—a, it having moreover a second folding line b—b. The three edges 15, protruding from the part 11 with respect to the contour of the part 12, are coated with reversible or fixed glue, adapted to adhere to itself; on the same face of the blank 10, a strip 16 of the part 11 is coated with the aforesaid glue, the strip 16 being adjacent to the folding line a—a.

Above the said folding line a—a, cut-outs or guards 17 are symmetrically formed with respect to the folding line b—b, their base portion being wider than the apex to make it easier the use with the printing device of a quick computer system. Sidewise of the blank 10, tearable and perforated strips 18 can be provided, to permit the engagement of the blank by the advancing hooks in a quick printing unit.

Figure 2:
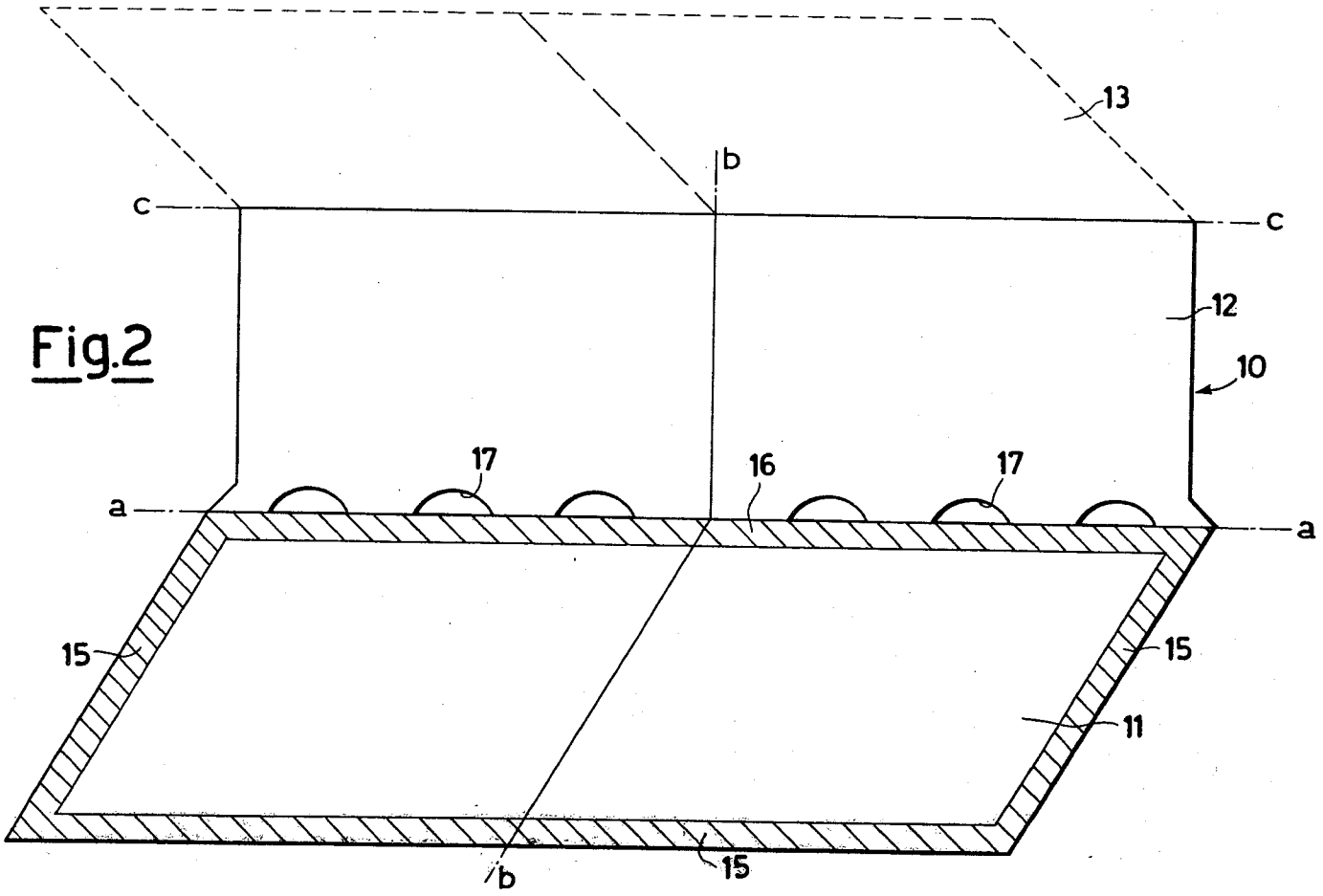
FIG. 2 is an isometric view, showing the first folding step of the blank of FIG. 1.
Figure 3:
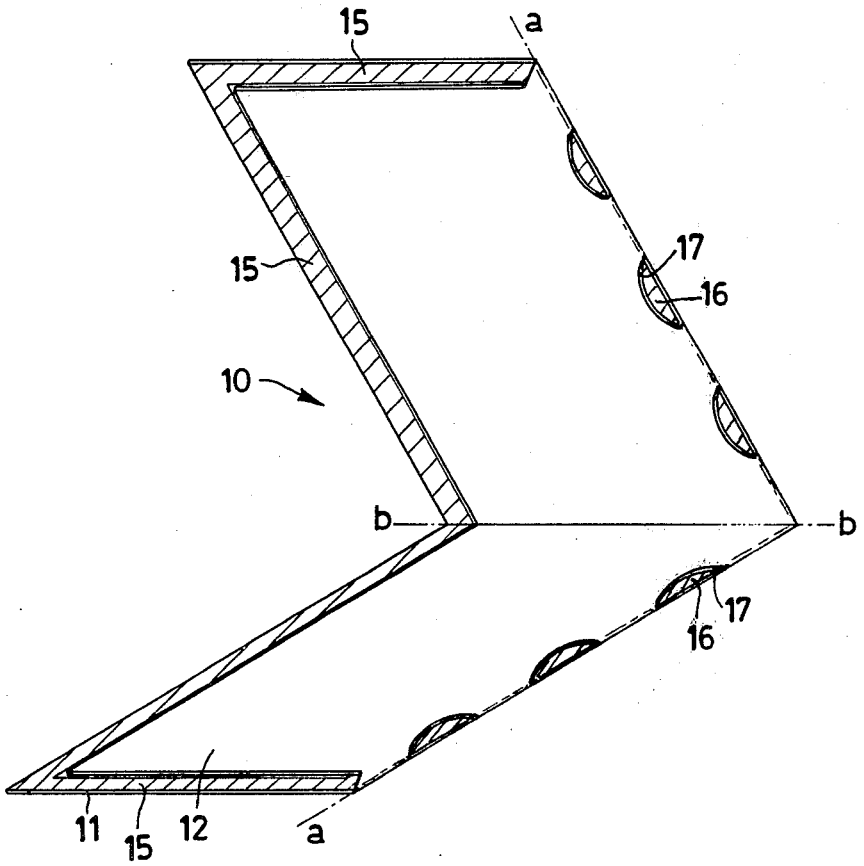
FIG. 3 is an isometric view showing the second folding step of the blank of FIG. 1.

In order to achieve the sealing of the said blank 10, it is firstly folded, as shown in FIG. 2, according to the folding line a—a, and then as shown in FIG. 3, folded again according to the folding line b—b, whereby the glue coating the three protruding edges 15 adheres to itself and the same occurs as regards the glue coating of the strip 16, in the portions remaining uncovered owing to the cut-outs 17, which upon the folding of the blank according to the folding line b—b fit to each other, thanks to their symmetrical positions with respect to the same folding line b—b.

The part 12 may be further extended in a part 13, as shown in FIG. 2, when the availability of a greater writing space is necessary. In the latter case there are three folding steps, namely a first folding step according to the line c—c, provided that the part 13 does not cover the cut-outs 17, a second folding step according to the folding line a—a, and a third folding step according to the folding line b—b: in this case the blank is six times folded, instead of four times.

The above described embodiment is only an example, and several changes as to the shape can be made within the scope of the present invention.

More particularly, the dimensions and the proportions of the parts 11 and 12 with respect to each other are not critical, it being sufficient that, upon the folding is effected, at least the edges 15 are left uncovered by the part 12. The shape and the number of the cut-outs 17 can be as desired, provided that the area of the strip 16, which remains uncovered, ensures a sufficiently strong sealing of the respective side of the folded blank.

The blank may be furthermore provided with folding and tearing lines, with possible cut-outs for the address reading, and with any other suitable manufacturing features, already known in the related art.

I claim:

1. In a transmission blank for information and data, adapted to remain stable in a folded condition, comprising a sheet having a first folding line for dividing it into a first part and a second part, said first part having protruding edges from the three sides thereof forming a first strip coated on one face thereof along said protruding edges with reversible or irreversible glue, the improvement comprising:

a second strip on the same face of said first part as said first strip, said second strip being adjacent to the said first folding line and being coated with glue; and a third strip on said second part being adjacent to said first folding line, said third strip being provided with spaced guards or cut-outs symmetrically positioned with respect to a second folding line on said sheet orthogonal to said first folding line, the area of said third strip between said guards or cut-outs ensuring a sufficiently strong sealing between said second strip and said third strip when said first and second parts are folded together over said first folding line.

2. The blank according to claim 1, wherein said cut-outs are close to each other and are of elongated shape.

3. The blank according to claim 1 or 2, whrein said glue coated edges of said first part protrude with respect to the contour of said second part when the latter is folded onto said first part.

4. The blank according to claim 3, wherein said second part has an extension foldable with respect to a third folding line to said second part, without interfering with the said glue coated edges.

5. The blank according to claim 1, including a third part connected with said second part and having a third fold line extending in the same direction as said first fold line.

6. The blank according to claim 5, wherein said second folding line extends transversely to said first and said third fold lines, so that folding of said third part over said second part along said third fold line and said second part over said first part along said first fold line and folding transversely along said second fold line provides for said protruding edges forming said first strip to adhere together and the uncovered portion of said second strip beneath said cut-outs in the folded condition folded along all three of said folds also being glued together.

7. The blank according to claim 1 or 6, wherein said blank is provided with tearable and perforated strips to permit engagement of said blank by advancing hooks in a quick printing unit, and said first line and guards or cut-outs extend transversely to said perforated strips.

* * * * *